US005677502A

United States Patent [19]

Laido

[11] Patent Number: 5,677,502

[45] Date of Patent: Oct. 14, 1997

[54] BASS DRUM ANCHOR SYSTEM

[76] Inventor: Michael B. Laido, P.O. Box 547, Franklin Lakes, N.J. 07417

[21] Appl. No.: 138,201

[22] Filed: Oct. 20, 1993

[51] Int. Cl.[6] ..... G10D 13/02

[52] U.S. Cl. ..... 84/421; 84/453; 248/205.2

[58] Field of Search ..... 84/421, 453; 248/205.2

[56] References Cited

U.S. PATENT DOCUMENTS 4,441,398 4/1984 Baker ..... 84/421

4,829,874 5/1989 Hoshino ..... 84/421

5,065,922 11/1991 Harris ..... 245/205.2

*Primary Examiner*—Cassandra C. Spyrou

*Attorney, Agent, or Firm*—Anthony D. Cipollone

[57] ABSTRACT

A novel and unique drum anchor using a female velcro base taped to the floor to which is anchored a male velcro. The male velcro is part of an assembly using a screw assembly which simply attaches to the bass drum to be held in place on the front and along each side of the drum on two positions with the use of a swivel strap to hold the entire unit in place.

2 Claims, 4 Drawing Sheets

BASS DRUM ANCHOR SYSTEM

BACKGROUND OF THE INVENTION

For many years a bass drum when used by a drummer continuously moves and slips along the ground and is not "anchored" permanently in position.

The drawbacks and problems of this occurrence are obvious. Not the least of the problems is the unevenness of the sound and vibration. The musician playing said drum loses control and concentration since part of his attention must be focused on making sure the bass drum remains relatively stable.

There have been several attempts to anchor a bass drum but have not been successful to the extent of the present simple invention. Previous methods tried leave marks on the floor of the stage are unstable and cumbersome to mention a few of the drawbacks.

SUMMARY OF THE INVENTION

It is the object of this invention to provide a stable support system which may give stable support to the beaten bass drum.

DESCRIPTION OF THE PREFERRED EMBODIMENT OF THE INVENTION

Figure 1:
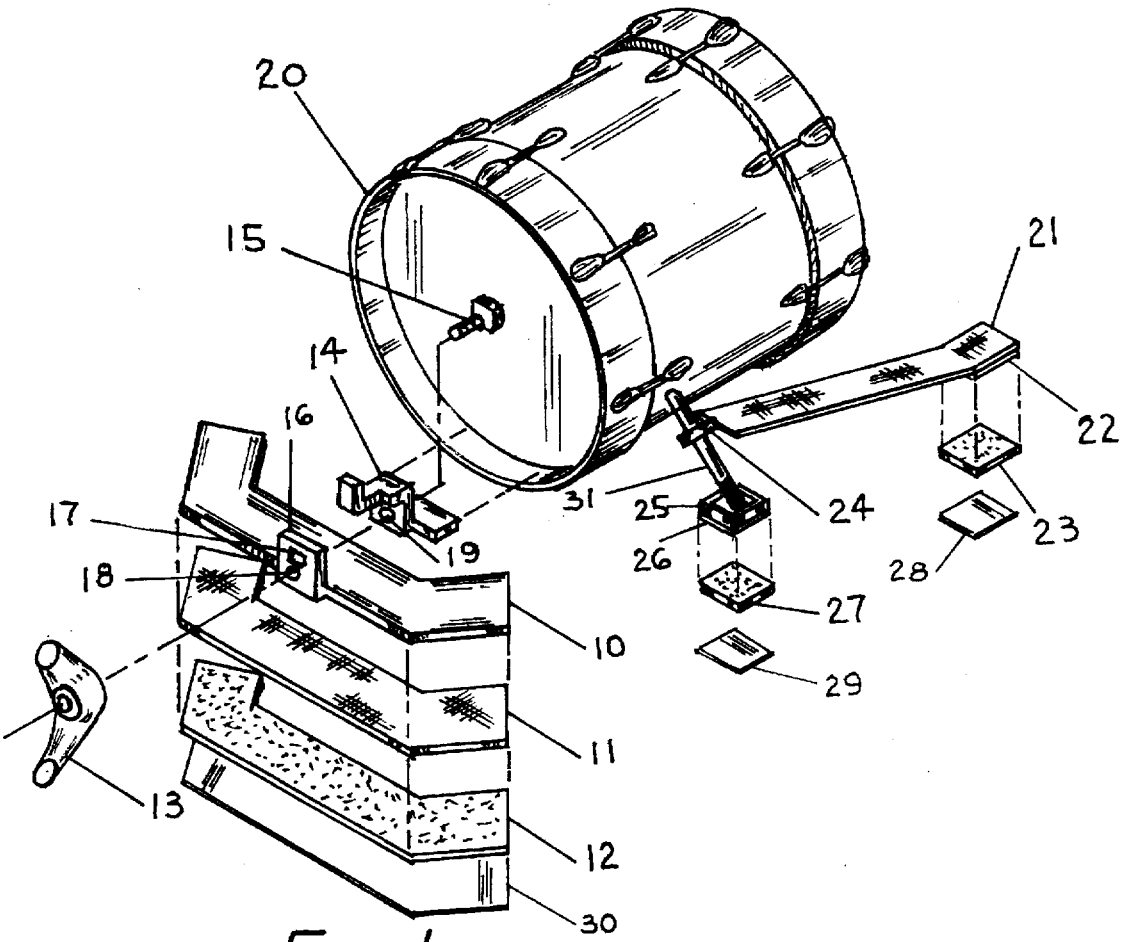
FIG. 1 is an orthogonol imploded view showing the entire invention.
Figure 2:
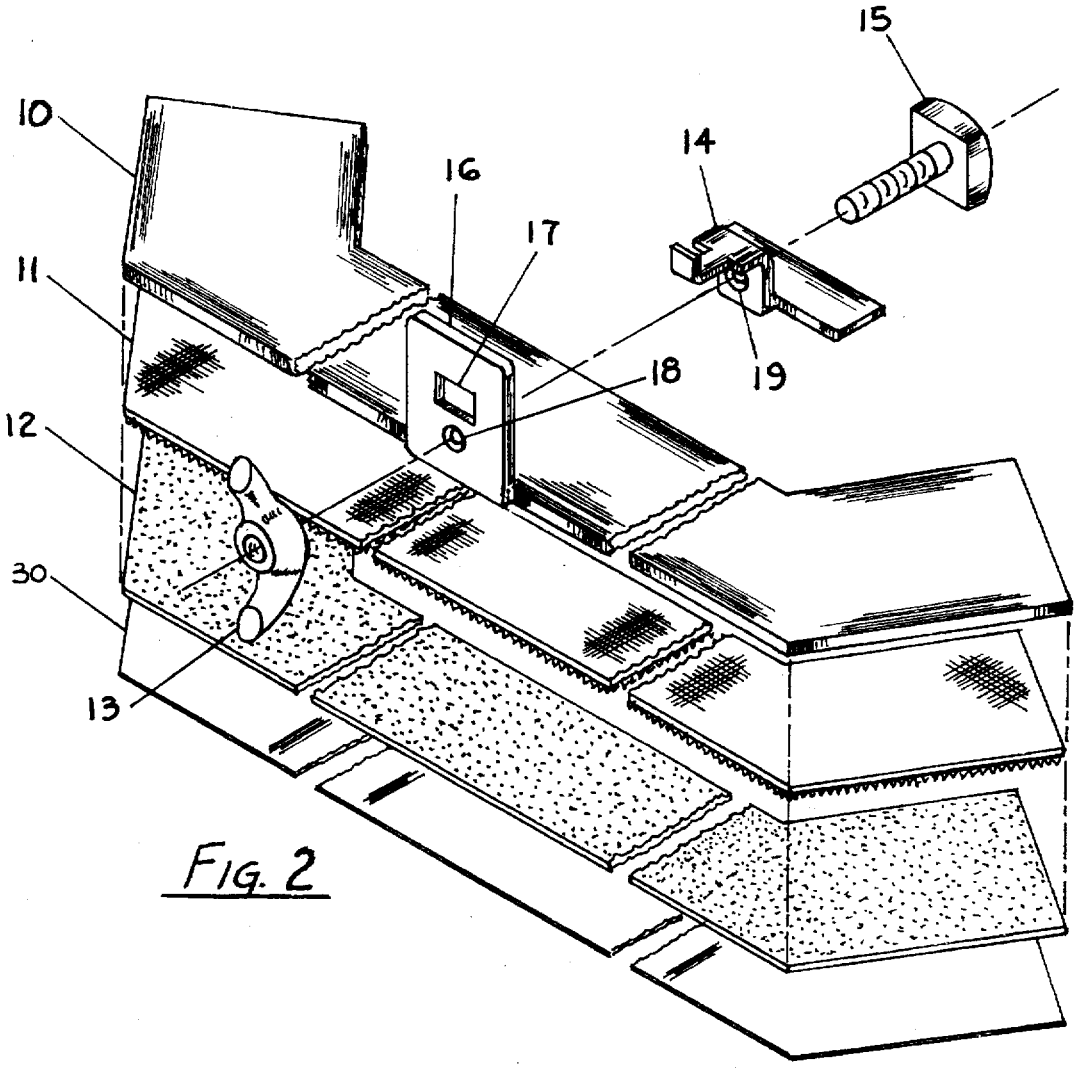
FIG. 2 is an orthogonal imploded view showing the frontal vertical support system for the bass drum.

The present invention will be described in detail referring to the accompanying drawings.

The bass drum according to the embodiment of the present invention shown in FIG. 1 through FIG. 6 shows a bass drum (20) with a male screw attachment (15) which fits through a hook member (14) with aperture (19) through which male screw attachment (15) is held in place to fit through aperture (19) in a plate (16) wherein hook member (14) fits into rectangular space (17) of a vertical frontal support assembly (10,11,12) held in place by bolt (13) which is secured on screw (15) going through an aperture (19&18) respectively on hook number (14) and plate (16).

Figure 6:
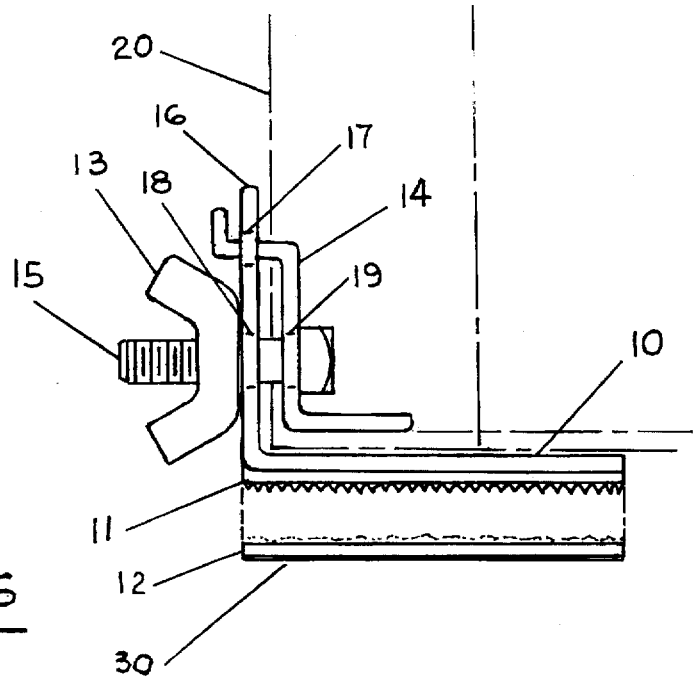
FIG. 6 is a side view of the frontal vertical support for the bass drum.

FIG. 6 shows plate (16) with base (10) to which the bottom face (11) of base (10) has a male velcro pad which becomes anchored with the top face female velcro pad (12) whose bottom face (30) is taped to the floor.

Figure 5:
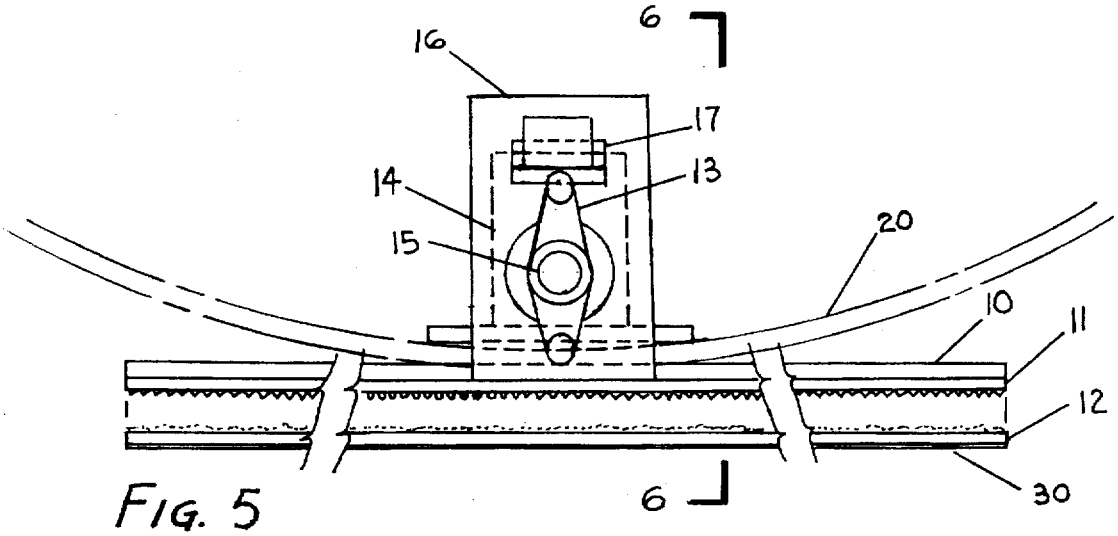
FIG. 5 is a frontal view of the frontal vertical support for the bass drum.

FIG. 5 shows the entire frontal support system from a frontal view with the angled sides.

Figure 3:
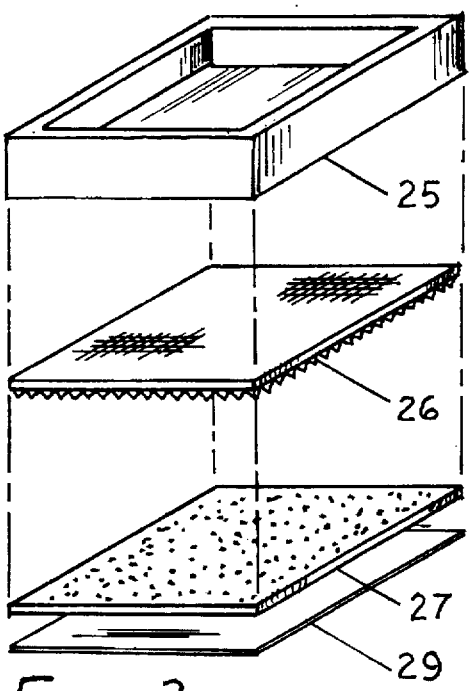
FIG. 3 shows the forward side support without attachment to swivel on the side of the drum.
Figure 4:
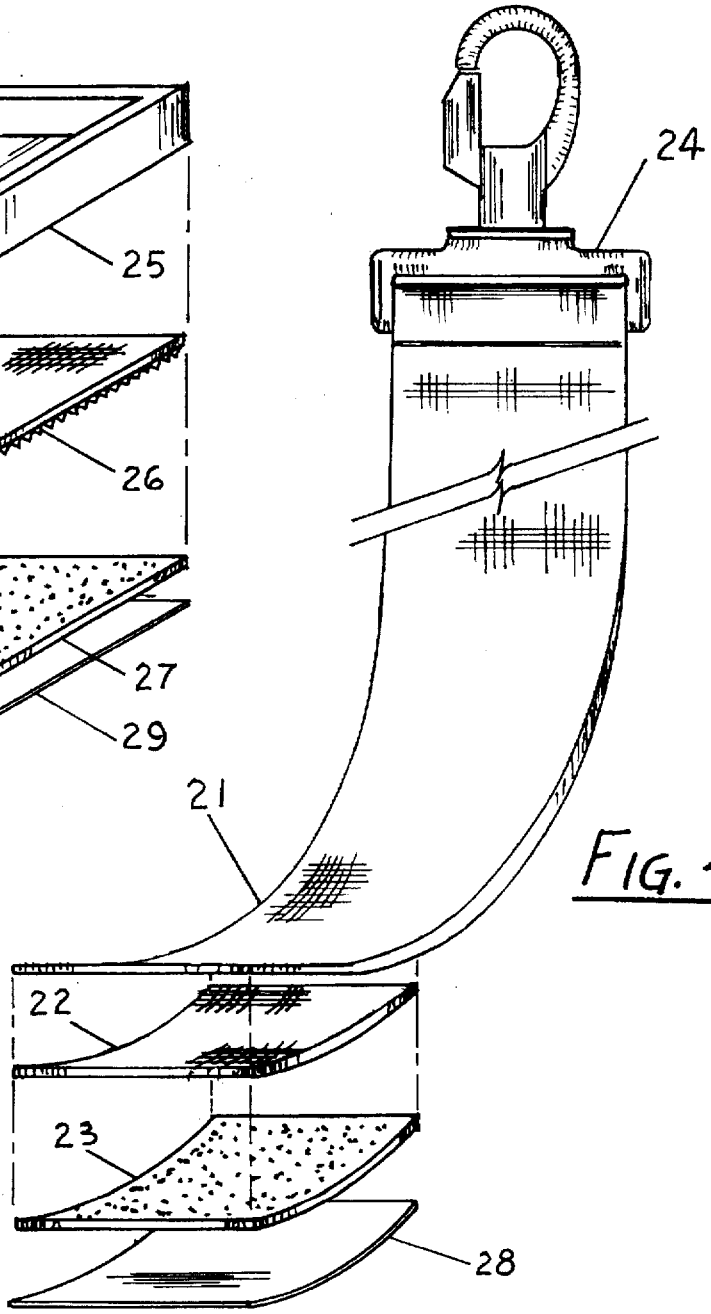
FIG. 4 shows the rearward side support with belt and swivel attachment.

FIG. 3 shows the exploded view of the forward side support (25) to which a pad containing the male velcro (26) is attached which becomes attached to top of female velcro pad (27) which is taped to floor at (29). Swivel anchor (28) on bass drum (20) is held on to frontal support (25) which has a swivel attachment (24) on a belt (21) which is held in place to the rearward support (22) by a male velcro pad (22) at the opposite end of said belt (21) which attaches to female velcro pad at (23) taped in place to the floor by adhesive surface at (29).

The foregoing system anchors said bass drum firmly and prevents its movement, stabilizing the said drum and reliable supporting said drum so that it will not slip or become disengaged while being beaten. The sound is not being influenced by movement and other distractions and the musician may concentrate on drum playing instead of keeping drum in place.

What is claimed is:

1. An apparatus for anchoring a bass drum to a floor while the bass drum is being played by musicians, said bass drum including a front, a rear and a side, comprising:

A vertical front support plate having a top surface and a bottom surface;

A front male velcro pad having a top face and a bottom face; said top face of said male velcro secured to the bottom surface of the vertical front support plate;

A front female velcro pad having a top face and a bottom face; said bottom face secured to said floor at a location approximate to the front of the bass drum; said top face of said female velcro pad engaging said bottom face of said male velcro pad;

Means for securing said top of said vertical front support plate to said front of said bass drum;

A swivel anchor having a first end and a second end; said first end secured to said side of said drum; a side male velcro pad having a top face and a bottom face; said top face secured to said second end of said swivel anchor;

A side female velcro pad having a top face and a bottom face; said bottom face of said side female velcro pad secured to said floor at a location approximate to the side of the drum; said top face of said side female velcro pad engaging said bottom face of said side male velcro pad;

A belt having a first end and second end;

A swivel secured to said swivel anchor and the said first end of said belt

A rearward side male velcro pad having a top face and a bottom face; said top face of said rearward side male velcro pad being secured to said end of said belt;

A rearward side female velcro pad having a top face and bottom face; said bottom face of said rearward female velcro pad being secured to floor at location approximate the rear and the side of the bass drum; said top face of said rearward side female velcro pad engaging said bottom face of said rearward side male velcro pad.

2. The apparatus according to claim 1, wherein:

said means for securing said vertical front support to said front of said bass drum including a hook member having an aperture with a first side and a second side; said hook member secured to said vertical front support plate; a screw secured to said front of said drum and positioned within said aperture from said first side with a portion thereof extending from said second side; a bolt secured to said portion of said screw extending from said second side.

* * * * *